US008759660B2

(12) United States Patent
Nakagawa et al.

(10) Patent No.: US 8,759,660 B2
(45) Date of Patent: Jun. 24, 2014

(54) ELECTRONIC MUSICAL INSTRUMENT

(75) Inventors: Mizuki Nakagawa, Hamamatsu (JP); Shun Takai, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 212 days.

(21) Appl. No.: 13/403,296

(22) Filed: Feb. 23, 2012

(65) Prior Publication Data

US 2012/0227574 A1 Sep. 13, 2012

(30) Foreign Application Priority Data

Mar. 11, 2011 (JP) ..... 2011-054688

(51) Int. Cl.
*G10H 1/36* (2006.01)
*G10H 5/00* (2006.01)
*G10H 5/02* (2006.01)

(52) U.S. Cl.
CPC ..... *G10H 5/00* (2013.01); *G10H 5/005* (2013.01); *G10H 5/02* (2013.01); *G10H 2210/066* (2013.01)
USPC ..... 84/634; 84/615

(58) Field of Classification Search
CPC ..... G10H 5/00; G10H 5/002; G10H 5/005; G10H 5/007; G10H 5/02; G10H 2210/066
USPC ..... 84/634, 615
See application file for complete search history.

(56) References Cited

U.S. PATENT DOCUMENTS

| | | | | |
|---|---|---|---|---|
| 5,179,240 | A * | 1/1993 | Mizuno et al. | 84/613 |
| 5,804,755 | A | 9/1998 | Furukawa | |
| 6,362,410 | B1 * | 3/2002 | Kira | 84/618 |
| 7,470,855 | B2 * | 12/2008 | Sakama et al. | 84/626 |
| 2003/0221543 | A1 * | 12/2003 | Takahashi et al. | 84/630 |
| 2010/0077907 | A1 * | 4/2010 | Tanaka et al. | 84/604 |

FOREIGN PATENT DOCUMENTS

JP 10097243 4/1998

* cited by examiner

*Primary Examiner* — Jianchun Qin
(74) *Attorney, Agent, or Firm* — David W. Victor; Konrad Raynes Davda & Victor LLP

(57) ABSTRACT

Provided are an electronic musical instrument, computer storage device, and method generating tones for held notes. Indication is made of held notes having pitches as held in response to receiving note-on information for the held notes from an input device of an electronic musical instrument while receiving hold information from a hold device of the electronic musical instrument. Note-on information is received for a received note having a pitch while generating the pitches for the held notes. Selection is made of one of the held notes to release according to a first selection criteria in response to determining that the pitch difference of the received note and at least one of the held notes does not exceed the predetermined number of tones or selection is made according to a second selection criteria if the pitch difference exceeds the predetermined number of tones.

32 Claims, 5 Drawing Sheets

ELECTRONIC MUSICAL INSTRUMENT

CROSS-REFERENCE TO RELATED FOREIGN APPLICATION

This application is a non-provisional application that claims priority benefits under Title 35, United States Code, Section 119(a)-(d) from Japanese Patent Application entitled "ELECTRONIC MUSICAL INSTRUMENT" by Mizuki NAKAGAWA and Shun TAKAI, having Japanese Patent Application Serial No. 2011-054688, filed on Mar. 11, 2011, which Japanese Patent Application is incorporated herein by reference in its entirety.

BACKGROUND OF THE INVENTION

Electronic musical instruments such as synthesizers and the like can generate tones with various kinds of tone colors. For imitating a performance played on a natural musical instrument by an electronic musical instrument, the imitated tone color needs to faithfully imitate the tone color of the natural musical instrument. In addition, the performer needs to understand characteristics peculiar to the musical instrument and perform pieces of music while operating user interfaces of the musical instrument (such as, for example, the keyboard, the pitch-bend lever, the modulation lever, HOLD pedal and the like) during his or her performance. Therefore, when a performer attempts to imitate a performance played on a certain musical instrument, using an electronic musical instrument, the performer needs to have good understanding of the characteristics of the musical instrument to be imitated, and is required to have high-level skills in performance technique to make full use of the user interface according to the characteristics during performance.

For example, in an arpeggio performance technique, which is one of the performance techniques for an acoustic guitar, multiple strings are played and sounded in succession. When the arpeggio performance is imitated by an electronic musical instrument, it is necessary to carry out the performance while stepping on the HOLD pedal to hold tones corresponding to keys that have been released (in other words, the silencing control on the tones is withheld to continue generation of the tones) so that the sounding tones would not be broken. However, when the performance is carried out while stepping on the hold pedal, and when too many sounds are held, for example, when sounds exceeding the number of the strings on a guitar are held, the identity of a guitar arpeggio would be harmed. Accordingly, the performer needs to switch on and off the hold pedal at appropriate timings, which requires high-level performance technique.

Japanese Patent Application No. 3671545, also published as U.S. Pat. No. 5,804,755, pertains to an electronic musical instrument with a fixed number of sound generation channels, and describes a technology pertaining to limiting the number of sound generation channels that can be allocated to resonance sounds, in which, when the number of resonance sounds has already reached the limited number of sound generation channels, one of the sound generation channels allocated to resonance sounds with a lower resonance sound signal level is silenced and released, and the released sound generation channel is allocated to the new resonance sound.

SUMMARY

Provided are an electronic musical instrument, computer storage device, and method generating tones for held notes. Indication is made in a memory device of held notes having pitches as held in response to receiving note-on information for the held notes from an input device of an electronic musical instrument while receiving hold information from a hold device of the electronic musical instrument. A sound source of the electronic musical instrument generates the pitches for the held notes. Note-on information is received the input device for a received note having a pitch while generating the pitches for the held notes. A determination is made as to whether a pitch difference of the pitch of the received note and at least one of the pitches of the held notes is less than a predetermined number of tones. Selection is made of one of the held notes to release according to a first selection criteria in response to determining that the pitch difference of the received note and at least one of the held notes exceeds the predetermined number of tones. Selection is made of one of the held notes to release according to a second selection criteria in response to determining that the pitch difference of the received note and the at least one of the held notes does not exceed the predetermined number of tones, wherein the first criteria and the second criteria select different of the held notes to release. The sound source device generates the selected one of the notes.

DETAILED DESCRIPTION

Figure 1:
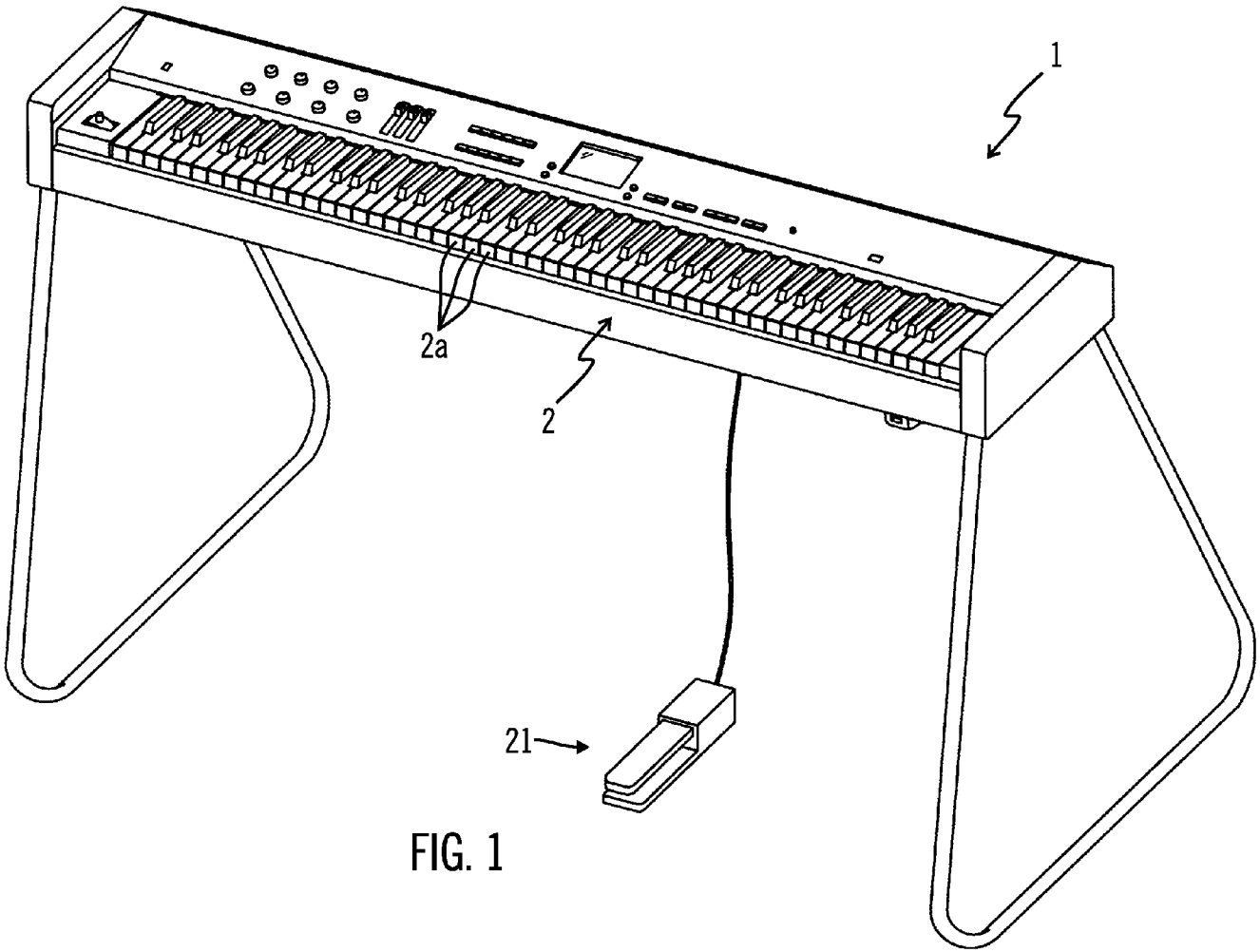
FIG. 1 illustrates an embodiment of an external appearance of an electronic musical instrument.

Described embodiments relate to electronic musical instruments and, more particularly, to an electronic musical instrument that can readily and sufficiently realize faithful imitation of an arpeggio performance played on a string musical instrument based on real-time performance operation by a performer.

A string musical instrument such as an acoustic guitar is characterized, due to the structure of the musical instrument, in that sounds of any of the strings being generated are silenced when the same strings are played. However, prior art techniques do not address the characteristic described above that upon plucking the same strings, the sounds that may be generated on the same string may unnaturally overlap, and the characteristics of a guitar may be lost.

In described electronic musical instrument embodiments, when tones held by a hold device (held tones) reach a predetermined number or above, a judging device judges as to whether a pitch difference between a tone held that has been most recently generated and a tone instructed to be generated by performance information inputted in an input device is within a predetermined value. If it is judged that the pitch difference is within the predetermined value, a silencing control device performs a silencing control on the tone held that is most recently generated. On the other hand, if it is judged that the pitch difference is not within the predetermined value, the silencing control device performs a silencing control on one of the tones that are held.

In further embodiments, when tones held by a hold device (tones held) reach a predetermined number or above, a judging device judges as to whether or not any of the tones held whose pitch difference with respect to a tone instructed to be generated by performance information inputted in an input device is within a predetermined value. If it is judged that there are tones held and having a pitch difference with respect to the tone instructed to be generated being within the predetermined value, a silencing control device performs a silencing control on one of the tones held having the pitch difference being within the predetermined value. On the other hand, if it is judged that there is no held tone having a pitch difference with respect to the tone instructed to be generated being within the predetermined value, then the silencing control device performs a silencing control on one of the tones held.

In certain described embodiments, when there are held tones in a predetermined number or greater, one of the tones among the held tones is subject to silencing control, and silenced. Therefore, when an attempt is made to imitate an arpeggio performance played on a string musical instrument such as an acoustic guitar, the number of tones that are simultaneously generated (in other words, the number of tones that are simultaneously emanated) can be controlled within the range in which the character of the string musical instrument to be imitated can be maintained, without depending on the performance technique (for example, a technique on pedal operation) of the performer, such that the arpeggio performance peculiar to the string musical instrument to be imitated can be readily realized.

Also, when the pitch difference between the tone held and most recently generated and the tone instructed to be generated by performance information inputted in the input device is within the predetermined value, the tone held and most recently generated is subject to the silencing control. On the other hand, in certain embodiments, when any of the tones held has a pitch difference within the predetermined value with respect to the tone instructed to be generated by performance information inputted in the input device, the tone held and having the tone difference within the predetermined value is subject to the silencing control. In the case of a string musical instrument such as an acoustic guitar, there is a tendency in its performance that the same string may be played if a pitch difference is less than a predetermined value, and is characterized by its own structure in that a preceding sound is silenced when a succeeding sound is played on the same string. Therefore, according to described embodiments, arpeggio performances that sufficiently reflect the performance tendency and the structural characteristic of a string musical instrument such as an acoustic guitar can be realized.

According to the above embodiments, imitation of an arpeggio performance played on a string musical instrument (for example, an acoustic guitar) based on real-time performance operation by the performer can be readily and sufficiently realized.

In further embodiments, when the judging device judges that the pitch difference is not within the predetermined value, the silence control device performs a silencing control on one of the held tones that has been generated earliest. Therefore, an arpeggio performance that sufficiently reflects the general characteristic of string musical instruments in which tones that have been generated successively on different strings are silenced in the order the tones have been generated (in other words, in the order the tones have been instructed to be generated).

In further embodiments, when the judging device judges that there are tones held whose pitch difference with respect to the tone instructed to be generated is within the predetermined value, one of the held tones having the smallest pitch difference among the held tones whose pitch difference is within the predetermined value is decided to be subject to the silencing control by the silencing control device. Therefore, even when there are plural tones held and having a pitch difference being within the predetermined value, the tone that is subject to the silencing control can be readily specified.

In yet further embodiments, when the judging device judges that there are tones held whose pitch difference with respect to the tone instructed to be generated is within the predetermined value, one of the held tones that has been generated earliest among the held tones whose pitch difference is within the predetermined value is decided to be subject to the silencing control by the silencing control device. Therefore, even when there are plural tones held whose pitch difference is within the predetermined value, the tone that is subject to the silencing control can be readily specified.

In further embodiments, when the judging device judges that there are tones held whose pitch difference with respect to the tone instructed to be generated is within the predetermined value, one of the tones held that has been generated most recently among the held tones whose pitch difference is within the predetermined value is decided to be subject to the silencing control by the silencing control device. Therefore, even when there are plural tones held whose pitch difference is within the predetermined value, the tone that is subject to the silencing control can be readily specified.

In still further embodiments, when the judging device judges that there is no tone held whose pitch difference with respect to the tone instructed to be generated being within the predetermined value, the silencing control device performs a silencing control on one of the tones held which has been generated earliest. Therefore, an arpeggio performance that sufficiently reflects the common characteristic of string musical instruments in which tones that have been generated successively on different strings are silenced in the order the tones have been played.

Embodiments of the invention will be described with reference to the accompanying drawings. FIG. 1 is an external appearance of an electronic musical instrument 1 in accordance with embodiments of the invention. As shown in FIG. 1, the electronic musical instrument 1 is an electronic keyboard musical instrument having a keyboard 2 composed of a plurality of keys 2*a*. A performer can play a desired performance piece by depressing or releasing the keys 2*a* of the keyboard 2 of the electronic musical instrument 1.

The keyboard 2 is one of the user interfaces operated by the performer, and outputs to a CPU 11 (see FIG. 2) note events that are pieces of performance information according to the MIDI (Musical Instrument Digital Interface) standard in response to key-depression and key-release operations on the keys 2*a* by the performer. More specifically, when the key 2*a* is depressed by the performer, the keyboard 2 outputs to the CPU 11 a note-on event (hereafter referred to as a "note-on") that is a piece of performance information indicating that the key 2*a* is depressed. On the other hand, when the key 2*a* that has been depressed by the performer is released, the keyboard 2 outputs to the CPU 11 a note-off event (hereafter referred to as a "note-off") that is a piece of performance information indicating that the depressed key 2*a* is released.

The electronic musical instrument 1 is configured to be able to connect to a pedal 21 that is operated by stepping motions imparted by the performer through a pedal connection interface (I/F) 14 (see FIG. 2), such that the pedal 21 can be used as a user interface. The pedal 21 is biased to an initial state (OFF position) when no operation is imparted by the performer, and changes to a stepped state (ON position) when the performer performs a stepping operation.

The electronic musical instrument 1 is also configured to be able to assign a desired one of functions to the pedal 21 connected thereto. The function assigned to the pedal 21 can be turned on and off according to the operation state of the pedal 21. In other words, when the pedal 21 is in the initial state, the assigned function is turned off, and when the pedal 21 is in the stepped state when being stepped on by the performer, the assigned function is turned on. In the following description, the initial state of the pedal 21 is called "OFF state," and the stepped state is called "ON state." In the present embodiment, a control number 64 (HOLD 1) of the MIDI standard is assigned to the pedal 21, thereby functioning the pedal 21 as a HOLD pedal. Therefore, even when the key 2*a* is released while the pedal 21 is in the ON state by the performer's operation, the electronic musical instrument 1 withholds a tone stop control (hereafter referred to as a "silencing control") caused by the releasing of the key, thereby continuing generation of the tone (holding the tone) corresponding to the key 2*a* that was released.

When the performer attempts to imitate an arpeggio performance played on an acoustic guitar by using the pedal 21 that functions as the HOLD pedal, the electronic musical instrument 1 is configured to realize the performance sufficiently characteristic to that of the acoustic guitar, without requiring high-level pedal operation techniques.

Figure 2:
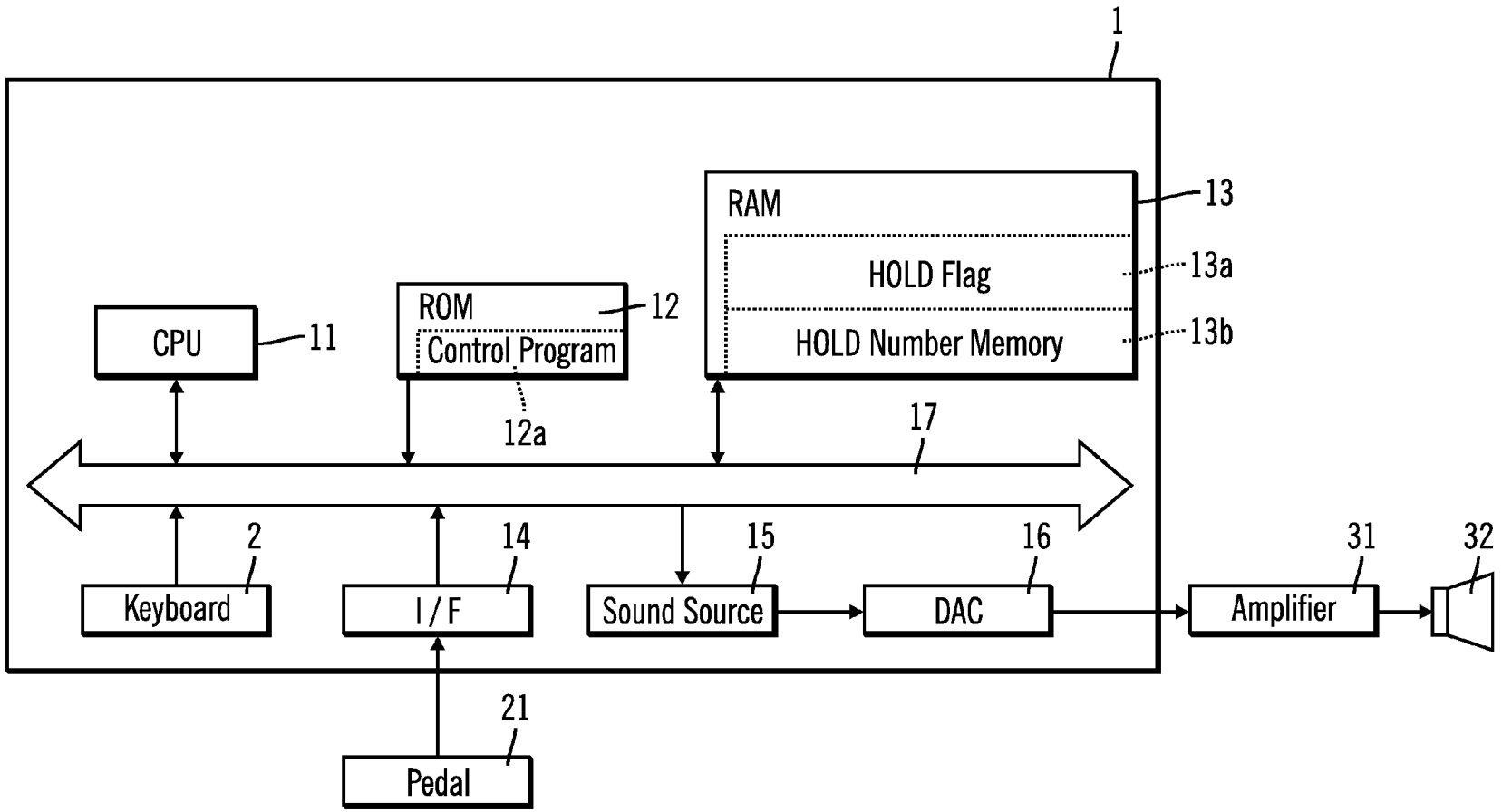
FIG. 2 illustrates an embodiment of a block diagram of an electrical composition of the electronic musical instrument.

FIG. 2 is a block diagram showing an electrical composition of the electronic musical instrument 1. As shown in FIG. 2, the electronic musical instrument 1 includes a Central Processing Unit (CPU (11, a Read Only Memory (ROM) 12, a Random Access Memory (RAM) 13, an interface (I/F) 14, and a sound source 15; and the components 11 through 15 and the keyboard 2 are mutually connected through a bus line 17. The electronic musical instrument 1 also includes a digital-to-analog converter (DAC) 16. The DAC 16 is connected to the sound source 15, and is also connected to an amplifier 31 that is provided outside the electronic musical instrument 1.

The CPU 11 is a central control unit that controls each of the components of the electronic musical instrument 1 according to fixed value data and a control program stored in the ROM 12 and the RAM 13. Upon receiving a note-on (a piece of performance information indicating that the key 2*a* is depressed) from the keyboard 2, the CPU 11 outputs a tone generation instruction to the sound source 15, whereby the sound source 15 starts generating a tone (an audio signal) according to the note-on.

When the pedal 21, as being the HOLD pedal, is in the OFF state, upon receiving a note-off (a piece of performance information indicating that the key 2*a* having been depressed is released) from the keyboard 2, the CPU 11 performs a silencing control by outputting a silencing instruction to the sound source 15. By this, the tone that is being generated by the sound source 15 is stopped. On the other hand, when the pedal 21, as being the HOLD pedal, is in the ON state, upon receiving a note-off from the keyboard 2, the CPU 11 withholds a silencing control (more specifically, an output of a silencing instruction) corresponding to the key 2*a* released. By withholding the silencing control, the sound source 15 does not stop generation of the tone corresponding to the key 2*a* released, and the generation of the tone is continued (in other words, the tone is held).

The ROM 12 is a non-rewritable memory, and stores a control program 12*a* to be executed by the CPU 11, fixed value data (not shown) to be referred to by the CPU 11 when the control program 12*a* is executed, and the like. It is noted that each of the processes shown in the flow charts in FIG. 3 and FIG. 4 may be executed by the control program 12*a*.

The RAM 13 is a rewritable memory, and has a temporary storage area for temporarily storing various kinds of data for the CPU 11 to execute the control program 12*a*. The temporary area of the RAM 13 includes a HOLD flag 13*a* and a HOLD number memory 13*b*.

The HOLD flag 13 is a flag that indicates as to whether or not a tone is held, and is provided for each note corresponding to each of the keys 2*a*. When the HOLD flag 13*a* on a note is set to ON, it means that the note is held. When the HOLD flag 13*a* on a note is set to OFF, it means that the note is not held.

The HOLD flags 13*a* on the entire notes are initialized to OFF when the electronic musical instrument 1 is powered on. When the key 2*a* having been depressed is released, while the pedal 21 is in the ON state, a tone corresponding to the note that corresponds to the key 2*a* released is held, and therefore the HOLD flag 13*a* corresponding to the note is set to ON. When the performer stops stepping on the pedal 21, all tones held are released from their hold state (in other words, the silencing control that has been withheld is executed), such that all the HOLD flags 13*a* that are set to ON are set to OFF.

Also, when a new key is depressed while the pedal 21 is in the ON state, if the number of notes whose HOLD flags 13*a* are set to ON has reached a predetermined number (four in the present embodiment), one of the notes, which is decided according to a predetermined condition, is released from its hold state. Therefore, even when the hold state is released according to this configuration, the HOLD flag 13*a* corresponding to the note that is released from the hold state is set to OFF.

The HOLD number memory 13*a* is a memory for counting the number of notes whose tones are held (in other words, notes whose HOLD flags 13*a* are set to ON). When one of the keys 2*a* is released while the pedal 21 is in the ON state, a tone corresponding to the note that is released is held (in other words, the HOLD flag 13*a* is switched from OFF to ON). Each of such events, 1 is added to the value of the HOLD number memory 13*b*. On the other hand, when the tone is released from its hold state, in other words, when the HOLD flag 13*a* is switched from ON to OFF, the value of the HOLD number memory 13*b* is reduced by the number of notes that are released from hold state.

The interface (I/F) 14 denotes an interface for connecting to the pedal 21. The interface (I/F) 14 is configured as a pin jack to which a pin plug provided at the end of a cable connecting to the pedal 21 can be detachably connected.

The sound source 15 generates tones with tone colors set by the performed at pitches corresponding to those of the keys 2*a* depressed or stops tones that are being generated, based on sound generation instructions or silencing instructions received from the CPU 11, respectively. Upon receiving a sound generation instruction from the CPU 11, the sound source 15 generates a tone (an audio signal) with a pitch, a sound volume and a tone color according to the sound generation instruction. The tone generated by the sound source 15 is supplied to the DAC 16 and converted to an analog signal, and outputted through an amplifier 31 from a speaker 32. On the other hand, upon receiving a silencing instruction from the CPU 11, the sound source 15 stops a tone that is being generated according to the silencing instruction. Accordingly, the tone that is being outputted from the speaker 32 is silenced.

Figure 3:
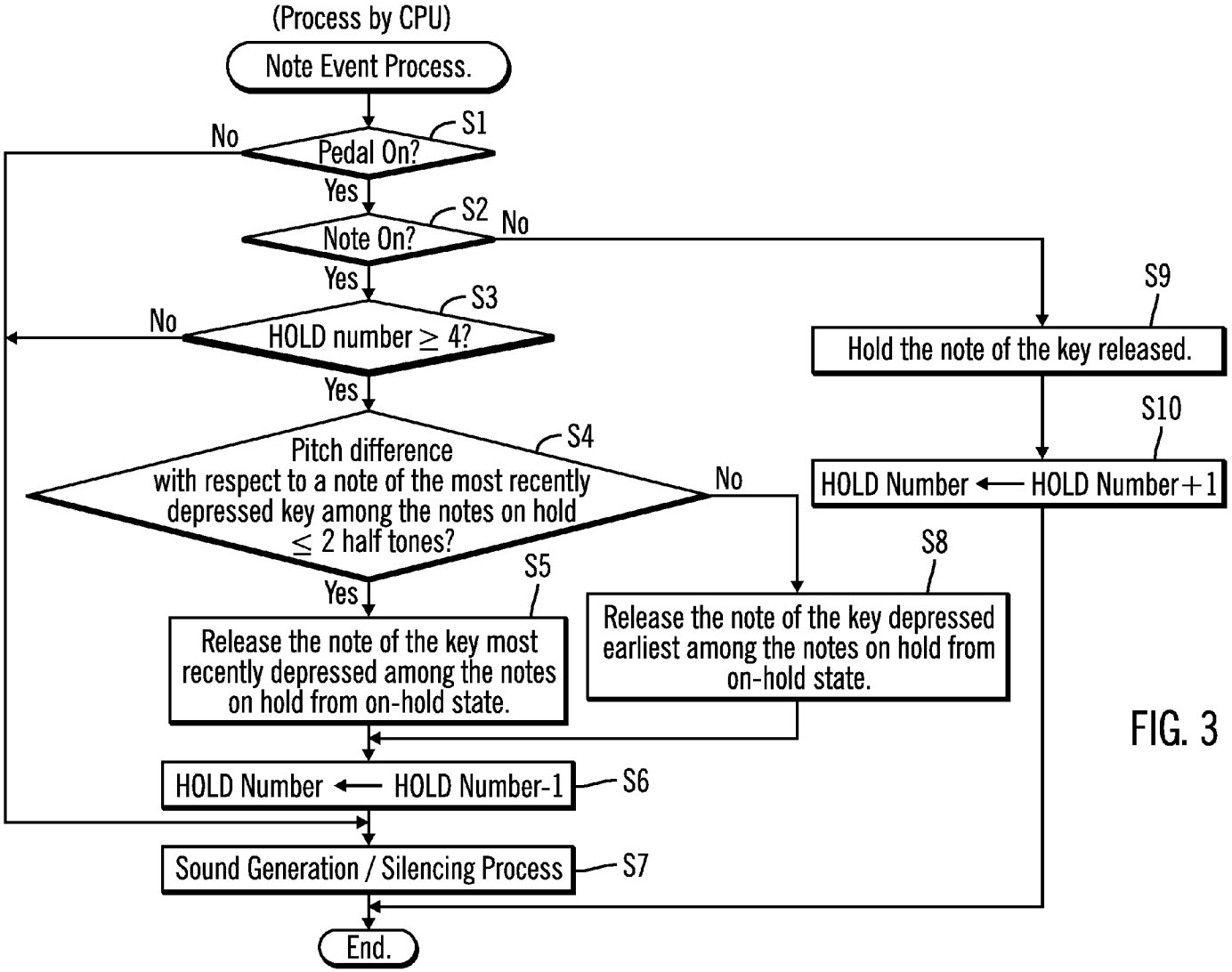
FIG. 3 illustrates an embodiment of a flow chart showing a note event process executed by a CPU of the electronic musical instrument.
Figure 4:
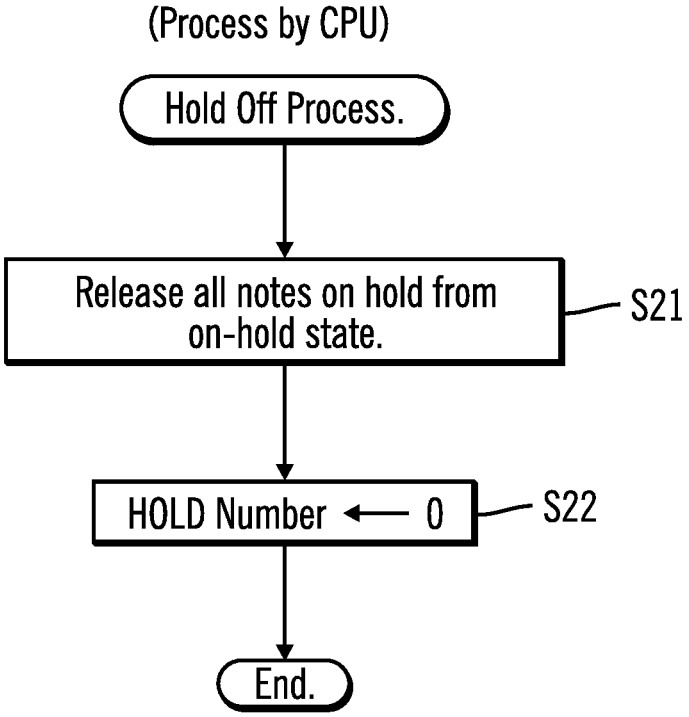
FIG. 4 illustrates an embodiment of a flow chart showing a pedal monitoring process executed by the CPU of the electronic musical instrument.

Referring to FIG. 3 and FIG. 4, the process executed by the CPU 11 of the electronic musical instrument 1 in accordance with present embodiments having the composition described above will be described. FIG. 3 is a flow chart of a note event process executed by the CPU 11. The note event process may be executed each time the CPU 11 receives a note event (a note-on or a note-off) from the keyboard 2, when a tone color of an acoustic guitar is set.

As shown in FIG. 3, the note event process confirms the I/F 14, and judges as to whether or not the pedal 21 is in the ON state (S1). When it is judged that the pedal 21 is in the OFF state (S1: No), the process proceeds to S7, a sound generation/silencing process is executed according the note event received from the keyboard 2 (S7). More specifically, when the note event received is a note-on, a sound generation instruction according to the received note-on is outputted to the sound source 15, thereby generating a tone corresponding to the note of the key depressed. On the other hand, in the case of a note-off, a silencing instruction according to the note-off received is outputted to the sound source 15, thereby stopping generation of a tone corresponding to the note of the key released. After the processing in S7, the note event process is ended.

In S1, when it is judged that the pedal 21 is in the ON state (S1: Yes), it is judged as to whether or not the note event received from the keyboard 2 is a note-on (S2). In S2, when it is judged that the received note event is a note-off (S2: No), based on the note-off, outputting of a silencing instruction to the note of the key released to the sound source 15 is withheld, and the tone corresponding to the note of the key released is held (S9). At this moment, the HOLD flag 13*a* corresponding to the note held in S9 is set to ON. Then, 1 is added to the value of the HOLD number memory 13*b* (S10), and the note event process is ended.

On the other hand, in S2, when it is judged that the received note event is a note-on (S2: Yes), it is judged as to whether or not the value of the HOLD number memory 13*b* is 4 or greater (S3). When the value of the HOLD number memory 13*b* is less than 4 (S3: No), the process proceeds to S7, and a sound generation/silencing processing is executed (S7). As the note event in this case is a note-on, in the sound generation/silencing processing (S7), a sound generation instruction according to the note-on received is outputted to the sound source 15, thereby generating a tone corresponding to the note of the key depressed.

In S3, when it is judged that the value of the HOLD number memory 13*b* is 4 or greater (S3: Yes), it is judged as to whether or not a pitch difference between the note of the key depressed this time and one of the notes which has been key-depressed most recently among the notes whose HOLD flags 13*a* are set to ON (in other words, the notes held) is 2 semitones or less (S4). In the present embodiment, the RAM 13 is provided therein with a table (not shown) that enables discrimination of the order of key depressions by storing notes that are key-depressed and the absolute time (the time managed within the electronic musical instrument 1) at the time of each of the key depressions. In S4, the table and the HOLD flag 13*a* of each of the notes are referred to, thereby specifying the note that has been key-depressed most recently among the notes held (in other words, the notes whose HOLD flags 13*a* are set to ON).

In S4, when it is judged that the pitch difference is 2 semitones or less (S4: Yes), a silencing instruction to the note that has been key-depressed most recently among the notes held is outputted to the sound source 15, thereby releasing the note from its hold state (S5). At this moment, the HOLD flag 13*a* corresponding to the note released from the hold state in S5 is set to OFF.

On the other hand, when it is judged that the pitch difference exceeds two half tones (S4: No), a silencing instruction to the note of the key that has been depressed earliest among the notes held is outputted to the sound source 15, thereby releasing the note from its hold state (S8). At this moment, the HOLD flag 13*a* corresponding to the note released from its hold state in S8 is set to OFF. It is noted that, in S8, like S4 described above, the table (not shown) in the RAM 13 that enables discrimination of the order of key depressions and the HOLD flag 13*a* of each of the notes are referred to, and the note that has been key-depressed earliest, among the notes held (in other words, the notes whose HOLD flags 13*a* are set to ON), is specified.

After the processing in S5 or S8, 1 is deducted from the value of the HOLD number memory 13*b* (S6), and a sound generation/silencing processing is executed based on the note event this time (a note-on event) (S7). In other words, in S7, a sound generation instruction based on the note-on received is outputted to the sound source 15, thereby generating a tone corresponding to the note that has been key-depressed.

According to the note event process described above, when one of the keys 2*a* is newly depressed, and the value of the HOLD number memory 13*b* has reached 4, among the four tones held, one of the tones is always released from its hold state. In this instance, the note to be released from its hold state is decided according to a pitch difference between the note of the key 2*a* that is newly depressed and the note that has been key-depressed most recently among the notes held.

More specifically, when the pitch difference exceeds two semitones, the note that has been key-depressed earliest among the notes held is released from its hold state. For example, let us assume a case where, while the pedal 21 is kept in the ON state, the notes are depressed or released in the following order: key-depression (C4)→key-release (C4)→key-depression (D4)→key-release (D4)→key-depression (E4)→key-release (E4)→key-depression (F4)→key-release (F4)→key-depression (A4). When the key A4 is depressed, the pitch difference between the note F4 that has been depressed most recently among the four notes that are currently held (C4, D4, E4 and F4) and the note that is depressed this time (A4) is four semitones, such that the note C4 that has been depressed earliest among the four notes currently held (C4, D4, E4 and F4) is released from its hold state.

On the other hand, when the pitch difference is two semitones or less, the note that has been depressed most recently among the notes held is released from its hold state. For example, let us assume a case where, while the pedal 21 is kept in the ON state, the notes are depressed or released in the following order: key-depression→(C4) key-release (C4)→key-depression (D4)→key-release (D4)→key-depression (E4)→key-release (E4)→key-depression (F4)→key-release (F4)→key-depression (G4). When the key G4 is depressed, the pitch difference between the note F4 that has been key-depressed most recently among the four notes that are currently held (C4, D4, E4 and F4) and the note that is key-depressed this time (G4) is two semitones, such that the note F4 that has been key-depressed most recently among the four notes currently held (C4, D4, E4 and F4) is released from its hold state.

FIG. 4 is a flow chart showing a hold-off process to be executed by the CPU 11. The hold-off process is executed when the CPU 11 monitors the I/F 14, and when the I/F 14 detects that the pedal 21 is switched from the ON state to the OFF state.

As shown in FIG. 4, in the hold-off process, first, a silencing instruction to each note is outputted to the sound source 15 for the entire notes that are held, thereby releasing the notes from their hold state (S21). At this moment, all of the HOLD flags 13*a* set to ON are set to OFF. After the processing in S21, the value of the HOLD number member 13*b* is set to zero (S22), and the hold-off process is ended.

As described above, according to the electronic musical instrument 1 of the present embodiment, when one of the keys 2*a* is depressed while the pedal 21 is kept in the ON state, and the number of notes held has already reached four, one of the notes among the notes held is released from its hold state. By this, generation of the tone corresponding to the note released from its hold state is stopped (in other words, silenced), such that the number of tones concurrently generated (in other words, the number of tones concurrently emanated) can be controlled within a range that enables the unique character of an acoustic guitar to be imitated to be maintained (for example, a value generally equal to 6 that is the number of the strings of a six-string acoustic guitar), and therefore the unique character of an acoustic guitar to be imitated can be prevented from being deteriorated. Therefore, when the performer attempts to imitate an arpeggio performance played on an acoustic guitar, an arpeggio performance unique to the acoustic guitar that is a string musical instrument to be imitated can be readily realized without depending on the technique on pedal operation of the performer.

Also, the note to be released from the hold state is decided according to the pitch difference between the pitch of the note (tone) corresponding to the key 2*a* that is newly depressed and the pitch of the note of the key that has most recently been depressed among the notes held. More specifically, when the pitch difference exceeds two semitones, the note that has been depressed earliest among the notes held is released from its hold state. On the other hand, when the pitch difference is less than two semitones, the note that has been key-depressed most recently among the notes held is released from its hold state. In the case of a string musical instrument that would silence a previously generated sound on one string when the same string is plucked, such as, an acoustic guitar, it is likely that the same string is plucked when the pitch difference between two notes is within a predetermined value. Therefore, by making the note having a pitch difference less than a predetermined value with respect to the newly depressed note to be the subject of silencing control, the performer can realize an arpeggio performance that sufficiently reflects the character unique to an acoustic guitar, i.e., a string musical instrument that would silence a previously generated sound on one string when the same string is plucked, by simply depressing keys in a manner of an arpeggio performance.

In one of the characteristic arpeggio techniques performed on an acoustic guitar, higher notes are successively played superposed on lower notes while sounding the lower notes. Therefore, according to the electronic musical instrument 1 of the present embodiments, in which, when a pitch difference of a newly key-depressed note with respect to notes on hole is small, the note that has recently been held (a sound on a higher note side) is silenced, such that sound generation of a lower tone that has been held earlier would more likely remain. Therefore, arpeggio unintended by the performer, in which generation of lower tones are silenced earlier, would be suppressed.

Next, referring to FIG. 5, a second embodiment will be described. In the first embodiment described above, when the number of notes held has already reached a predetermined number, when one of the keys 2*a* is depressed, one of the notes is decided to be released from its hold state based on a pitch difference between the depressed key 2*a* (note) and the note that has been key-depressed most recently among the notes held. In contrast, in accordance with the second embodiment, when the number of notes held has reached a predetermined number when the key 2*a* is depressed, one of the notes to be released from hold state is decided based on comparison of differences between the pitch of the key-depressed note and the pitch of each of the entire notes held. In the second embodiment, sections identical with those of the first embodiment described above will be appended with the same references, and their description will be omitted.

Figure 5:
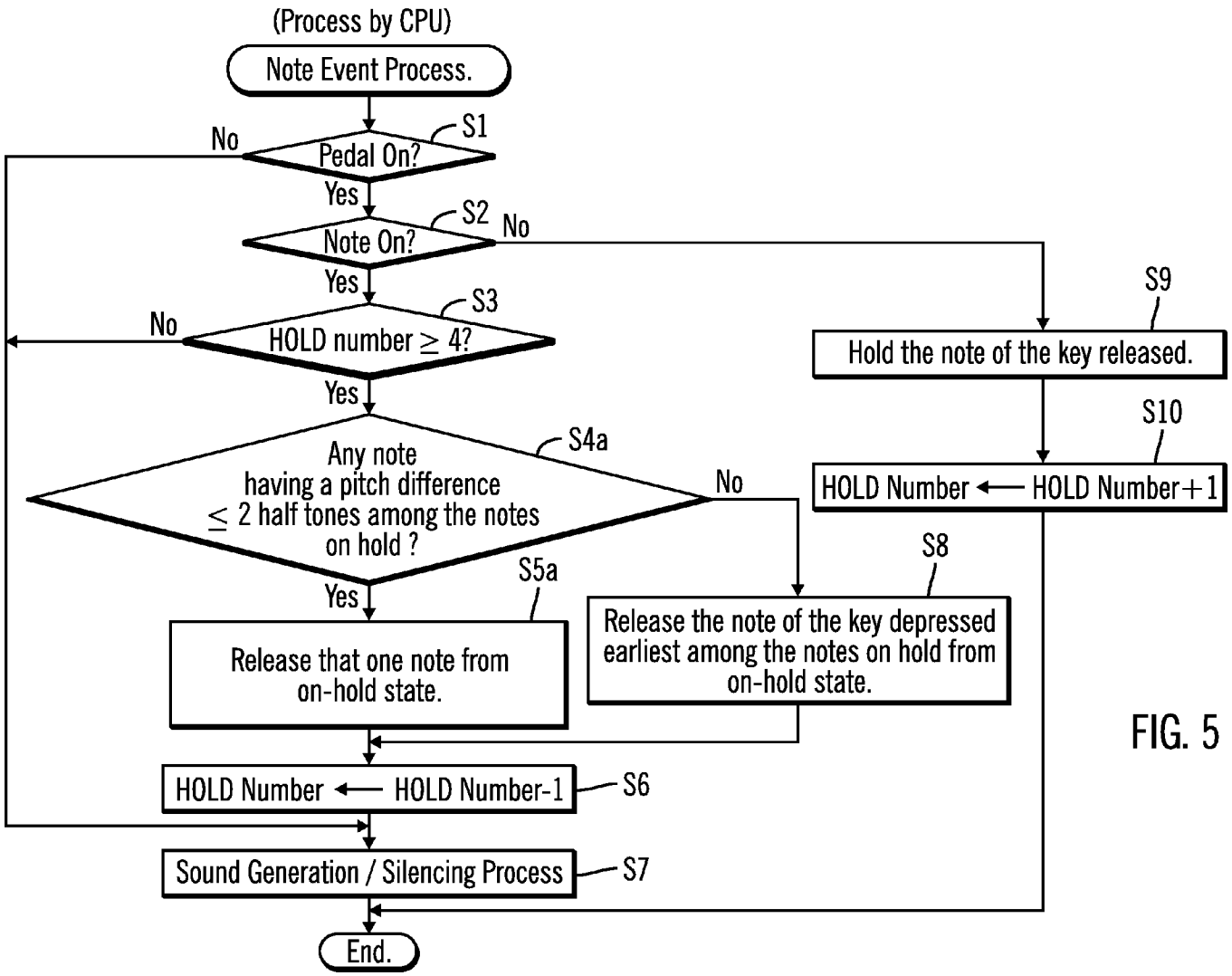
FIG. 5 illustrates an embodiment of a flow chart showing a note event process

FIG. 5 is a flow chart showing a note event process in accordance with the second embodiment. The note event process in accordance with the second embodiment is also executed each time the CPU 11 receives a note event from the keyboard 2, when the tone color of an acoustic guitar is set, like the note event process in accordance with the first embodiment (see FIG. 3).

The note event process of the second embodiment is different from the first embodiment in that the operations in S4 and S5 in the note event process shown in FIG. 3 are changed to operations in S4*a* and S5*a*, respectively.

More specifically, in the note event process of the second embodiment, in S3, when it is judged that the value of the HOLD number memory 13*b* is four or greater (S3: Yes), a judgment is made as to whether or not there is any note having a pitch difference of 2 semitones or less with respect to the note that is key-depressed this time among the notes with their HOLD flags 13*a* set to ON (in other words, the notes held) (S4*a*).

When it is judged that there are any notes, among the notes held, having a pitch difference of 2 semitones or less with respect to the note that is depressed this time (S4*a*: Yes), a silencing instruction to one note, among the notes held, that comes under a predetermined condition, is outputted to the sound source 15, thereby releasing that one note from its hold state (S5*a*). In this instance, the HOLD flag 13*a* corresponding to the note released from hold state in S5*a* is set to OFF. After the processing in S5*a*, the process proceeds to S6.

In S5*a*, when there is only one note among the notes held having a pitch difference of two semitones or less with respect to the note that is depressed this time, that only one note may be a target as the one note that comes under a predetermined condition. When there is a plurality of such notes, one of the notes having a smallest pitch difference with respect to the note that is depressed this time may be a target. Alternatively, when there is a plurality of notes among the notes held having a pitch difference of two semitones or less with respect to the note that is depressed this time, one of the notes that has been depressed earliest may be set as a target as the one note that comes under a predetermined condition, or one of the notes that has been depressed most recently may be set as a target as the one note that comes under a predetermined condition.

On the other hand, when it is judged that there is no note, among the notes held, having a pitch difference of two semitones or less with respect to the note that is depressed this time (S4*a*: No), the process proceeds to S8, where the HOLD flag 13*a* corresponding to one of the notes with their HOLD flags 13*a* being set to ON which has been depressed earliest is set to OFF, and a silencing instruction is outputted to the sound source 15, thereby releasing the note from its hold state (S8). After the processing in S8, the process proceeds to S6, like the first embodiment.

As described above, in accordance with the second embodiment, like the first embodiment, the number of tones concurrently generated can be controlled within a range in which the character unique to a string musical instrument to be imitated can be maintained, and therefore an arpeggio performance that identifies the string musical instrument to be imitated can be readily realized without depending on the technique on pedal operation of the performer. Moreover, a note to be released from hold state is decided according to a pitch difference with respect to a note that is newly depressed, the performer can realize an arpeggio performance that sufficiently reflects the characteristic of a sting musical instrument that would silence a previously generated sound on one string when the same string is plucked, like an acoustic guitar, by simply depressing keys in a manner of an arpeggio performance.

The invention is described above with respect to described embodiments. However, the invention is not limited to the embodiments described above, and it can be readily presumed that various modifications and improvements can be made within the range that do not depart from the subject matter of the invention.

For example, each of the embodiments described above is configured such that the CPU 11 executes each of the operations shown in FIGS. 3 through 5 to enable the performer to readily and sufficiently realize an arpeggio performance played on a string musical instrument such as an acoustic guitar. However, operations such as shown in FIGS. 3-5 may be executed by the sound source 15.

Also, each of the embodiments described above is configured such that the operations shown in FIGS. 3 through 5 are executed when a tone color of an acoustic guitar is set. However, the configuration is not limited to an acoustic guitar, and is similarly applicable to other tone colors of any string musical instruments that are capable of arpeggio performance like an acoustic guitar.

Also, in each of the embodiments described above, when the number of notes held has reached four in the judging step in S3 of the note event process (FIG. 3, FIG. 5), the process proceeds to S4 or S4*a*. However, the threshold value (in other words, the upper limit value in the number of notes held) to be used in the judging step in S3 is not particularly limited, as long as the number of notes held does not acoustically cause a feeling of wrongness as the sound of a musical instrument with a tone color set (for example, an acoustic guitar). In other words, the threshold value used in the judging step in S3 of the note event process (FIG. 3 and FIG. 5) may be configured such that it can be changed according to any tone color set therein. Alternatively, the threshold value used in the judging step in S3 may be configured such that it can be changed by the user.

Also, in each of the embodiments described above, the electronic musical instrument 1 to which the pedal 21 is detachably connected is used. However, an electronic musical instrument constructed in one piece with the pedal 21 may be used. Also, an operation element to which HOLD is assigned is not limited to the mode of a pedal (the pedal 21), but is also applicable to other modes such as a lever, a button, and the like. Also, HOLD assigned to an operation element such as the pedal 21 is not limited to HOLD 1 according to the MIDI standard, but may be HOLD 2.

Also, in each of the embodiments described above, the electronic musical instrument 1 constructed in one piece with the keyboard 2 is used. However, an electronic musical instrument in accordance with the invention may be configured as a sound source module to which a keyboard that outputs note-on and note-off events like the keyboard 2, a sequencer or the like can be detachably connected.

What is claimed is:

1. An electronic musical instrument comprising:

an input device for inputting performing information that instructs generation or silencing of a tone with a predetermined pitch;

a tone generation device that generates or silences a tone with a predetermined pitch based on performance information inputted by the input device;

a hold device that, when a silencing of a tone being generated by the tone generation device is instructed by performance information inputted by the input device, withholds a silencing control to hold the tone being generated;

a judging device that, when a predetermined number or more of tones are held by the hold device, judges as to whether or not there are tones held having a pitch difference within a predetermined value with respect to a tone instructed to be generated by performance information inputted in the input device; and a silencing control device that, when the judging device judges that there are tones held having a pitch difference within the predetermined value with respect to the tone instructed to be generated, performs a silencing control on one of the tones held having the pitch difference within the predetermined value and, when the judging device judges that there is no tone held having a pitch difference within the predetermined value with respect to the tone instructed to be generated, performs a silencing control on one of the tones held.

2. The electronic musical instrument of claim 1, wherein, when the judging device judges that there are tones held having a pitch difference within the predetermined value with respect to the tone instructed to be generated, the silencing control device performs a silencing control on the tone held having the smallest pitch difference among the tones held having the pitch difference within the predetermined value.

3. The electronic musical instrument of claim 1, wherein, when the judging device judges that there are tones held having a pitch difference within the predetermined value with respect to the tone instructed to be generated, the silencing control device performs a silencing control on the tone held that has been generated earliest among the tones held having the pitch difference within the predetermined value.

4. The electronic musical instrument of claim 1, wherein, when the judging device judges that there are tones held having a pitch difference within the predetermined value with respect to the tone instructed to be generated, the silencing control device performs a silencing control on the tone held that has been generated most recently among the tones held having the pitch difference within the predetermined value.

5. The electronic musical instrument of claim 1, wherein, when the judging device judges that there is no tone held having a pitch difference within the predetermined value with respect to the tone instructed to be generated, the silencing control device performs a silencing control on the tone held that has been generated earliest.

6. An electronic musical instrument, comprising:

an input device;

a sound source;

a hold device;

a processor;

a memory device; and a computer storage device including a program executed by the processor to perform operations, the operations comprising:

indicating in the memory device held notes having pitches as held in response to receiving note-on information for the held notes from the input device while receiving hold information from the hold device;

causing the sound source to generate the pitches for the held notes;

receiving from the input device note-on information for a received note having a pitch while generating the pitches for the held notes;

determining whether a pitch difference of the pitch of the received note and at least one of the pitches of the held notes is less than a predetermined number of tones;

selecting one of the held notes to release according to a first selection criteria in response to determining that the pitch difference of the received note and at least one of the held notes does not exceed the predetermined number of tones;

selecting one of the held notes to release according to a second selection criteria in response to determining that the pitch difference of the received note and the at least one of the held notes exceeds the predetermined number of tones, wherein the first criteria and the second criteria select different of the held notes to release; and causing the sound source to silence the generating of the selected one of the notes.

7. The electronic musical instrument of claim 6, wherein the operations further comprise:

determining whether a number of the held notes exceeds a predetermined number of held notes in response to receiving the note-one information for the received note, wherein the operations of the selecting of one of the held notes according to the first criteria and the second criteria are performed in response to determining that the number of the held notes exceeds the predetermined number of held notes.

8. The electronic musical instrument of claim 6 wherein the selecting one of the held notes according to the first criteria comprises selecting one of the held notes having most recently received note-on information among the held notes.

9. The electronic musical instrument of claim 8, wherein the selecting one of the notes according to the second criteria comprises selecting one of the held notes having earliest received note-on information among the held notes.

10. The electronic musical instrument of claim 6 wherein selecting one of the notes according to the first criteria comprises:

selecting the held note having the pitch within the predetermined number of tones from the pitch of the received note in response to only one of the held notes having the pitch within the predetermined number of tones from the pitch of the received note;

selecting the held note having the pitch having a smallest pitch difference from the pitch of the received note among the held notes in response to multiple of the held notes having the pitches within the predetermined number of tones from the pitch of the received note.

11. The electronic musical instrument of claim 6 wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having earliest received note-on information among the held notes in response to multiple of the held notes having the pitches within the predetermined number of tones from the pitch of the received note.

12. The electronic musical instrument of claim 6 wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having most recently received note-on information among the held notes in response to multiple of the held notes having the pitches within the predetermined number of tones from the pitch of the received note.

13. The electronic musical instrument of claim 6, wherein the predetermined number of tones comprises a predetermined number of half tones.

14. The electronic musical instrument of claim 6, wherein the operations of determining the pitch difference of the received note and the held notes and selecting one of the held notes to release based on the first and second selection criteria are performed in response to receiving note-on information when a tone color of a string instrument is set.

15. A computer storage device including a program executed by a processor to perform operations with respect to an electronic musical instrument having an input device, a sound source, a hold device, and a memory device, wherein the operations comprise:

indicating in the memory device held notes having pitches as held in response to receiving note-on information for the held notes from the input device while receiving hold information from the hold device;

causing the sound source to generate the pitches for the held notes;

receiving from the input device note-on information for a received note having a pitch while generating the pitches for the held notes;

determining whether a pitch difference of the pitch of the received note and at least one of the pitches of the held notes is less than a predetermined number of tones;

selecting one of the held notes to release according to a first selection criteria in response to determining that the pitch difference of the received note and at least one of the held notes does not exceed the predetermined number of tones;

selecting one of the held notes to release according to a second selection criteria in response to determining that the pitch difference of the received note and the at least one of the held notes exceeds the predetermined number of tones, wherein the first criteria and the second criteria select different of the held notes to release; and causing the sound source to silence the generating of the selected one of the notes.

16. The computer storage device of claim 15, wherein the operations further comprise:

determining whether a number of the held notes exceeds a predetermined number of held notes in response to receiving the note-one information for the received note, wherein the operations of the selecting of one of the held notes according to the first criteria and the second criteria are performed in response to determining that the number of the held notes exceeds the predetermined number of held notes.

17. The computer storage device of claim 15 wherein the selecting one of the held notes according to the first criteria comprises selecting one of the held notes having most recently received note-on information among the held notes.

18. The computer storage device of claim 17, wherein the selecting one of the notes according to the second criteria comprises selecting one of the held notes having earliest received note-on information among the held notes.

19. The computer storage device of claim 15, wherein selecting one of the notes according to the first criteria comprises:

selecting the held note having the pitch within the predetermined number of tones from the pitch of the received note in response to only one of the held notes having the pitch within the predetermined number of tones from the pitch of the received note;

selecting the held note having the pitch having a smallest pitch difference from the pitch of the received note among the held notes in response to multiple of the held notes having the pitches within the predetermined number of tones from the pitch of the received note.

20. The computer storage device of claim 15, wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having earliest received note-on information among the held notes in response to multiple of the held notes having the pitches within the predetermined number of tones from the pitch of the received note.

21. The computer storage device of claim 15, wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having most recently received note-on information among the held notes in response to multiple of the held notes having the pitches within the predetermined number of tones from the pitch of the received note.

22. The computer storage device of claim 15, wherein the predetermined number of tones comprises a predetermined number of half tones.

23. The computer storage device of claim 15, wherein the operations of determining the pitch difference of the received note and the held notes and selecting one of the held notes to release based on the first and second selection criteria are performed in response to receiving note-on information when a tone color of a string instrument is set.

24. A method, comprising indicating in a memory device held notes having pitches as held in response to receiving note-on information for the held notes from an input device of an electronic musical instrument while receiving hold information from a hold device of the electronic musical instrument;

causing a sound source of the electronic musical instrument to generate the pitches for the held notes;

receiving from the input device note-on information for a received note having a pitch while generating the pitches for the held notes;

determining whether a pitch difference of the pitch of the received note and at least one of the pitches of the held notes is less than a predetermined number of tones;

selecting one of the held notes to release according to a first selection criteria in response to determining that the pitch difference of the received note and at least one of the held notes does not exceed the predetermined number of tones;

selecting one of the held notes to release according to a second selection criteria in response to determining that the pitch difference of the received note and the at least one of the held notes exceeds the predetermined number of tones, wherein the first criteria and the second criteria select different of the held notes to release; and causing the sound source to silence the generating of the selected one of the notes.

25. The method of claim 24, further comprising:

determining whether a number of the held notes exceeds a predetermined number of held notes in response to receiving the note-one information for the received note, wherein the operations of the selecting of one of the held notes according to the first criteria and the second criteria are performed in response to determining that the number of the held notes exceeds the predetermined number of held notes.

26. The method of claim 24 wherein the selecting one of the held notes according to the first criteria comprises selecting one of the held notes having most recently received note-on information among the held notes.

27. The method of claim 26, wherein the selecting one of the notes according to the second criteria comprises selecting one of the held notes having earliest received note-on information among the held notes.

28. The method of claim 24, wherein selecting one of the notes according to the first criteria comprises:

selecting the held note having the pitch within the predetermined number of tones from the pitch of the received note in response to only one of the held notes having the pitch within the predetermined number of tones from the pitch of the received note;

selecting the held note having the pitch having a smallest pitch difference from the pitch of the received note among the held notes in response to multiple of the held notes having the pitches within the predetermined number of tones from the pitch of the received note.

29. The method of claim 24, wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having earliest received note-on information among the held notes in response to multiple of the held notes having the pitches within the predetermined number of tones from the pitch of the received note.

30. The method of claim 24, wherein selecting one of the notes according to the first criteria comprises:

selecting the held note having the pitch within the predetermined number of tones from the pitch of the received note in response to only one of the held notes having the pitch within the predetermined number of tones from the pitch of the received note; and selecting the held note having most recently received note-on information among the held notes in response to multiple of the held notes having the pitches within the predetermined number of tones from the pitch of the received note.

31. The method of claim 24, wherein the predetermined number of tones comprises a predetermined number of half tones.

32. The method of claim 24, wherein the operations of determining the pitch difference of the received note and the held notes and selecting one of the held notes to release based on the first and second selection criteria are performed in response to receiving note-on information when a tone color of a string instrument is set.

* * * * *